US008905231B2

(12) United States Patent
Couch, III et al.

(10) Patent No.: US 8,905,231 B2
(45) Date of Patent: Dec. 9, 2014

(54) COVER FOR PORTABLE ELECTRONIC DEVICE

(71) Applicants: Quest C. Couch, III, New Braunfels, TX (US); Shannon E. Couch, New Braunfels, TX (US)

(72) Inventors: Quest C. Couch, III, New Braunfels, TX (US); Shannon E. Couch, New Braunfels, TX (US)

( * ) Notice: Subject to any disclaimer, the term of this patent is extended or adjusted under 35 U.S.C. 154(b) by 32 days.

(21) Appl. No.: 13/836,347

(22) Filed: Mar. 15, 2013

(65) Prior Publication Data

US 2014/0131225 A1 May 15, 2014

Related U.S. Application Data

(60) Provisional application No. 61/725,352, filed on Nov. 12, 2012.

(51) Int. Cl.

| | |
|---|---|
| ***B65D 5/52*** | (2006.01) |
| ***B65D 85/00*** | (2006.01) |
| ***A45C 11/38*** | (2006.01) |
| ***A45C 11/00*** | (2006.01) |
| ***A45C 11/18*** | (2006.01) |
| ***A45C 13/02*** | (2006.01) |
| ***A45C 13/10*** | (2006.01) |

(52) U.S. Cl.

CPC ..... *A45C 11/38* (2013.01); *A45C 11/00* (2013.01); *A45C 11/182* (2013.01); *A45C 13/02* (2013.01); *A45C 13/1069* (2013.01); *A45C 2011/003* (2013.01); *A45C 2013/025* (2013.01); *A45C 2013/026* (2013.01); *A45C 2200/15* (2013.01)

USPC ..... 206/320; 206/45.24; 206/762

(58) Field of Classification Search

USPC ..... 206/45.23, 45.24, 320, 759–762

See application file for complete search history.

(56) References Cited

U.S. PATENT DOCUMENTS

| | | | | |
|---|---|---|---|---|
| 3,367,679 | A | 2/1968 | Slanhoff | |
| 5,555,614 | A | 9/1996 | Book | |
| 5,720,464 | A | 2/1998 | Meinscher et al. | |
| D658,187 | S | 4/2012 | Diebel | |
| 8,328,008 | B2 * | 12/2012 | Diebel et al. | 206/45.24 |
| 8,714,351 | B2 * | 5/2014 | Toulotte | 206/320 |
| 2010/0206923 | A1 | 8/2010 | McNamara et al. | |

(Continued)

OTHER PUBLICATIONS

Smartsound, http://us.cygnett.com/smartsound-1.html; iPad 2 case compatible with smart cover, dated 2011, printed Dec. 11, 2013 (2 pages).

(Continued)

*Primary Examiner* — Bryon Gehman

(74) *Attorney, Agent, or Firm* — Cox Smith Matthews Incorporated; Courtenay B. Allen

(57) ABSTRACT

A cover for a portable electronic device may have a plurality of foldable panels and an easel that is positionable in a deployed position to support a readable object within a field viewable through an opening in one of the panels that is aligned with a camera of the portable electronic device so that the camera may capture an image of the readable object. The cover may also have an extendable and retractable sound reflector for reflecting sound from a speaker of the portable electronic device toward a user. A stand for such a portable electronic device may have a receptacle configured to receive the device and at least one leg configured to place the receptacle a predetermined distance away from a surface on which the stand is resting such that a readable object on the surface is readable by the camera through an opening in the receptacle.

18 Claims, 13 Drawing Sheets

(56) References Cited

U.S. PATENT DOCUMENTS

| | | | | |
|---|---|---|---|---|
| 2010/0238119 | A1 | 9/2010 | Dubrovsky et al. | |
| 2011/0297566 | A1* | 12/2011 | Gallagher et al. | 206/320 |
| 2012/0019113 | A1 | 1/2012 | Hale | |
| 2012/0043234 | A1 | 2/2012 | Westrup | |
| 2012/0211377 | A1 | 8/2012 | Sajid | |
| 2013/0092562 | A1* | 4/2013 | Wyner et al. | 206/45.23 |
| 2013/0313142 | A1* | 11/2013 | Wen | 206/320 |
| 2014/0076748 | A1* | 3/2014 | Padilla | 206/45.23 |

OTHER PUBLICATIONS

Universal Tablet Cases, http://us.cygnett.com//tablet/universal-tablet.html?_store=us; Universal Tablet Cases Products, dated 2011, printed Dec. 11, 2013 (1 page).

Internatiional Search Report and Written Opinion issued in corresponding PCT App. Serial No. PCT/US2013/069487 dated Apr. 14, 2014 (10 pages).

* cited by examiner

COVER FOR PORTABLE ELECTRONIC DEVICE

CROSS REFERENCE TO RELATED APPLICATIONS

This application claims priority to U.S. Provisional Patent Application No. 61/725,352 filed Nov. 12, 2012, the disclosure of which is incorporated herein by reference.

FIELD

This application relates generally to the field of covers for portable electronic devices.

BACKGROUND

Many portable electronic devices have a built-in camera and software applications that are capable of capturing data from business cards, checks, or other documents or readable objects using the camera. However, a challenge exists in holding such a portable electronic device and readable item in a stable position so that the capturing may be accomplished in an efficient and accurate manner. In addition, the built-in sound speaker in such devices is typically directed away from the operator, resulting in lower volume and reduced quality of sound.

SUMMARY

A cover for a portable electronic device may have a plurality of foldable panels and an easel that is positionable in a deployed position in which the easel is configured to support a readable object within a field viewable through an opening in one of the panels that is aligned with a camera of the portable electronic device. In the deployed position, the easel may hold the readable object in a stable position so that it may be efficiently and accurately captured by the camera. The easel may also be positionable in an undeployed position in which it is substantially flush with one of the panels so that the cover may be folded into a compact and protective configuration about the portable electronic device. The cover may also have an extendable and retractable sound reflector that may be used to reflect sound from a speaker of the portable electronic device toward a user.

In an alternative embodiment, a stand for a portable electronic device including a camera may have a receptacle configured to receive the portable electronic device and at least one leg configured to place the receptacle (and hence the camera) a predetermined distance away from a surface on which the stand is resting such that a readable object on the surface is within a field viewable through an opening in the receptacle that is aligned with the camera. One or more of the at least one leg may serve as a guide to position the readable object in the proper viewable field with respect to the camera. The stand may thus hold the portable electronic device steady so that the camera may accurately and efficiently capture an image of the readable object.

DETAILED DESCRIPTION

Figure 1:
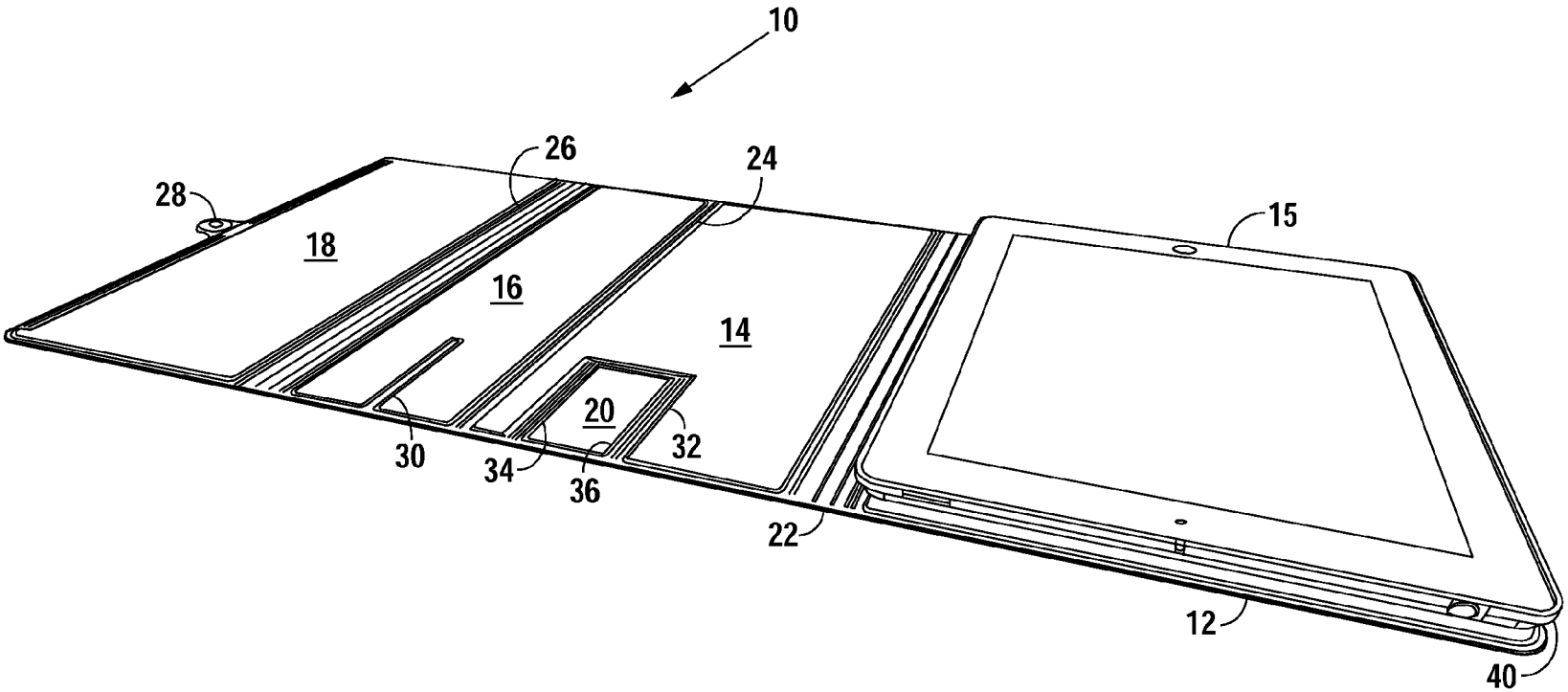
FIG. 1 is a perspective view of a cover and a portable electronic device positioned thereon, the cover being in an open position.

As used herein, the following terms should be understood to have the indicated meanings:

When an item is introduced by "a" or "an," it should be understood to mean one or more of that item.

"Comprises" means includes but is not limited to.

"Comprising" means including but not limited to.

"Having" means including but not limited to.

"Portable electronic device" means any portable programmable machine capable of executing machine-readable instructions. A portable electronic device may include but is not limited to a handheld or portable general purpose computer, microprocessor, digital signal processor, personal computer (PC), personal digital assistant (PDA), laptop computer, notebook computer, smartphone (such as Apple's iPhone™, Motorola's Atrix™ 4G, and Research In Motion's Blackberry™ devices, for example), tablet computer (such as Apple's iPad™, Samsung's Galaxy™, Amazon's Kindle™, and Toshiba's Excite™ devices, for example), netbook computer, portable media player (such as Microsoft's Zune HD™ and Apple's iPod Touch™ devices, for example), wearable computer, point of sale device, or a combination thereof. A portable electronic device may comprise one or more processors, which may comprise part of a single machine or multiple machines.

As shown in FIGS. 1-8, a cover 10 for a portable electronic device 15 may have a main panel 12, a support panel 14, a base panel 16, and a closure panel 18. Panels 12-18 may be made of any suitable materials and sized and shaped to receive any desirable portable electronic device 15, such as an Apple iPad™ tablet computer having a built-in camera, for example, in a receptacle 40. In some embodiments, panels 12-18 may be made of a suitable substrate, such as chipboard, paperboard, fiberboard, plastic, or the like, to provide sufficient stiffness, and the substrate may be covered with a suitable covering, such as vinyl, leather, or fabric, for example, to provide a desired look and feel and a suitable degree of protection. In some embodiments, one or more layers of padding material, such as foam, rubber, or felt, for example, may be placed between the substrate and the covering to provide an extra degree of protection for the portable electronic device 15 in the event it is dropped or otherwise subjected to harsh static or dynamic forces. Alternatively, in some embodiments, panels 12-18 may be made of a monolithic structure rather than a layered structure. An opening 38 may be provided in panel 12 and aligned with a camera of portable electronic device 15. An easel 20 may be provided in panel 14 to serve as a platform for holding a business card, check, or other readable object 25 to be captured by the camera, as further described below.

Figure 2:
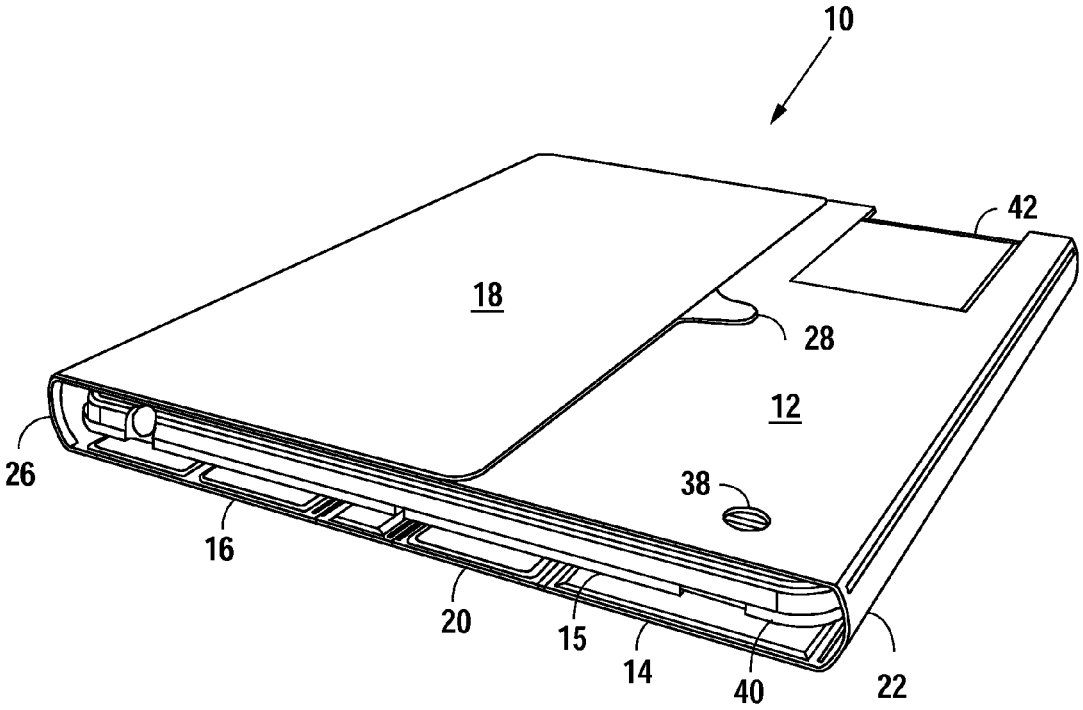
FIG. 2 is a perspective view of the cover and portable electronic device of FIG. 1, the cover being in a closed position.
Figure 3:
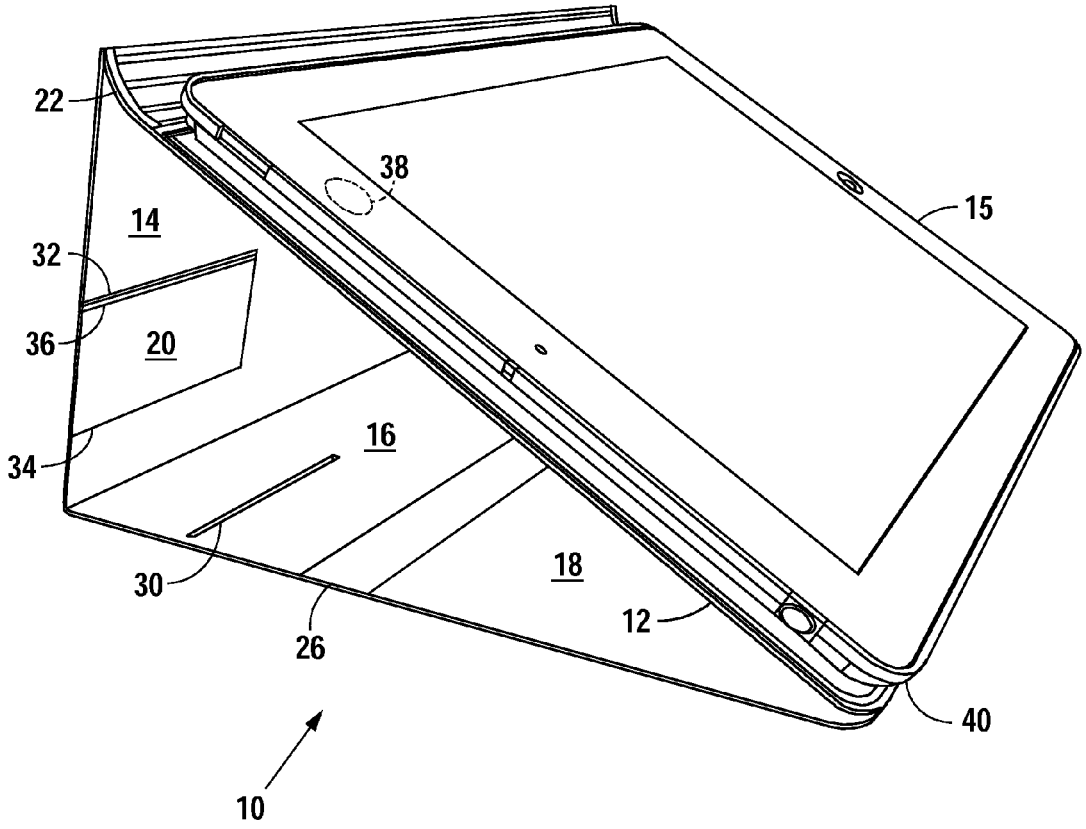
FIG. 3 is a left perspective view of the cover and portable electronic device of FIG. 1, the cover being in a deployed position, wherein an easel is shown in an undeployed position.
Figure 4:
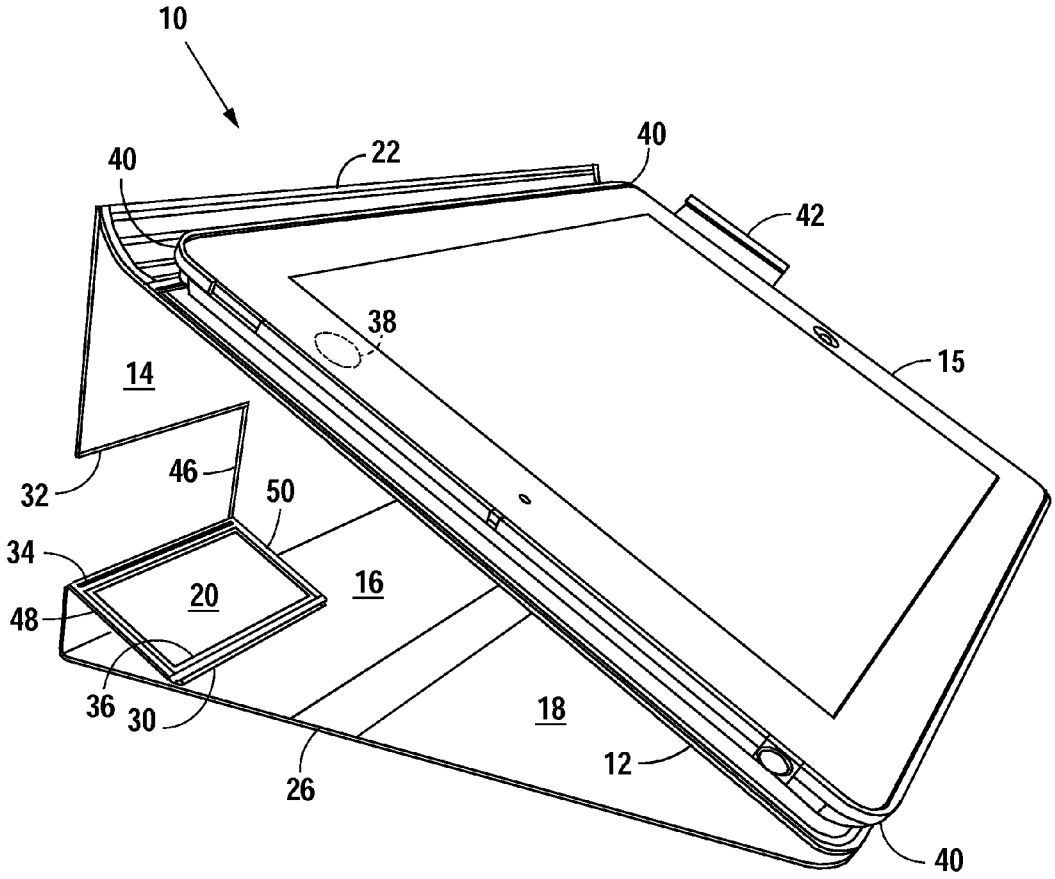
FIG. 4 is a left perspective view of the cover and portable electronic device of FIG. 1 similar to FIG. 3, except the easel is shown in a deployed position, and a sound reflector is shown in an extended position.

Panels 12-18 may be connected via a plurality of hinges 22-26, which facilitate the manipulation of cover 10 into several different positions, including an open position as shown in FIG. 1, a closed position as shown in FIG. 2, and a deployed position as shown in FIGS. 3-8. The deployed position may be a triangular configuration as shown, or it may be some other desired configuration. Similarly, a hinge 34 may be provided to facilitate the manipulation of easel 20 into an undeployed position as shown in FIG. 3 and a deployed position as shown in FIG. 4. Hinges 22-26 and 34 may be integral with panels 12-18 and easel 20, respectively, or such hinges may be distinct from panels 12-18 and easel 20, respectively.

Referring more particularly to FIGS. 1, 3, 4, and 8, easel 20 may be hingedly connected to panel 14 along hinge 34, and easel 20 may have a free edge 50 to allow easel 20 to move between the deployed and undeployed positions. In the undeployed position shown in FIG. 3, free edge 50 of easel 20 may be generally flush with edge 46 of panel 14. Although easel 20 is shown being located at an outer portion of panel 14 such that an outer edge of easel 20 is aligned with an outer edge of panel 14, easel 20 may be located at an inner portion of panel 14 such that the outer edge of panel 14 is continuous rather than notched as shown in FIG. 4. Cooperating closure elements 32 and 36 may be provided on panel 14 and easel 20, respectively, to releasably hold easel 20 in the undeployed position until such time as a user may desire to place easel 20 in the deployed position. For example, closure elements 32 and 36 may include complementary snap components, latch components, hook-and-loop fasteners, a magnet or metal-and-magnet combination, or other suitable means of releasable closure. In the deployed position shown in FIG. 4, closure element 36 of easel 20 may be engaged with a stabilizer 30 located on panel 16 that may serve to releasably hold easel 20 in the deployed position until such time as a user may desire to place easel 20 back in the undeployed position. For example, stabilizer 30 may include a snap component, latch component, hook-and-loop fastener component, magnet or metal component, or other suitable component that is complementary to closure element 36 of easel 20. In some embodiments, stabilizer 30 and closure element 32 of panel 14 may be of the same type so as to cooperate with closure element 36 of easel 20 in the same manner. For example, stabilizer 30 and closure element 32 may include one of a metal or magnet component, and closure element 36 may include the other complement of a metal or magnet component, such that an attractive magnetic force of suitable strength is provided to hold easel 20 in place in the deployed and undeployed positions, respectively, until repositioned by a user. Alternatively, stabilizer 30 and closure element 32 may include one of a hook or loop fastener, and closure element 36 may include the other complement of a hook or loop fastener, for example. Of course, any suitable combination of closure elements may be used. In some embodiments, stabilizer 30 may include a protrusion that extends a short distance from the surface of panel 16 and thereby serves as a mechanical stop to further stabilize easel 20 in the deployed position and thereby make cover 10 more resilient to forces that may otherwise tend to collapse or perturb cover 10 from its deployed position. Closure elements 32, 36 and stabilizer 30 may be located on a surface of panel 14, easel 20, and panel 16, respectively, or partially or fully recessed or embedded therein.

Alternatively, in some embodiments, easel 20 and stabilizer 30 may be switched such that easel 20 is hinged on panel 16 instead of panel 14 and stabilizer 30 is provided on panel 14 instead of panel 16. In such alternative embodiments, which may have similar closure elements for easel 20 as described above, easel 20 may be folded upward from an undeployed position in which it is substantially flush with panel 16 to a deployed position in which an edge thereof is engaged with stabilizer 30 on panel 14. Of course, still other alternative configurations are possible as well, as will be appreciated by persons of ordinary skill in the art. For example, in some embodiments, panels 16 and 18 may be wholly or partially eliminated and hinges 22 and 34 may be configured to permit a predetermined degree of rotation, respectively, such that panel 14 and easel 20 releasably lock into desired positions with respect to the camera when deployed.

Figure 8:
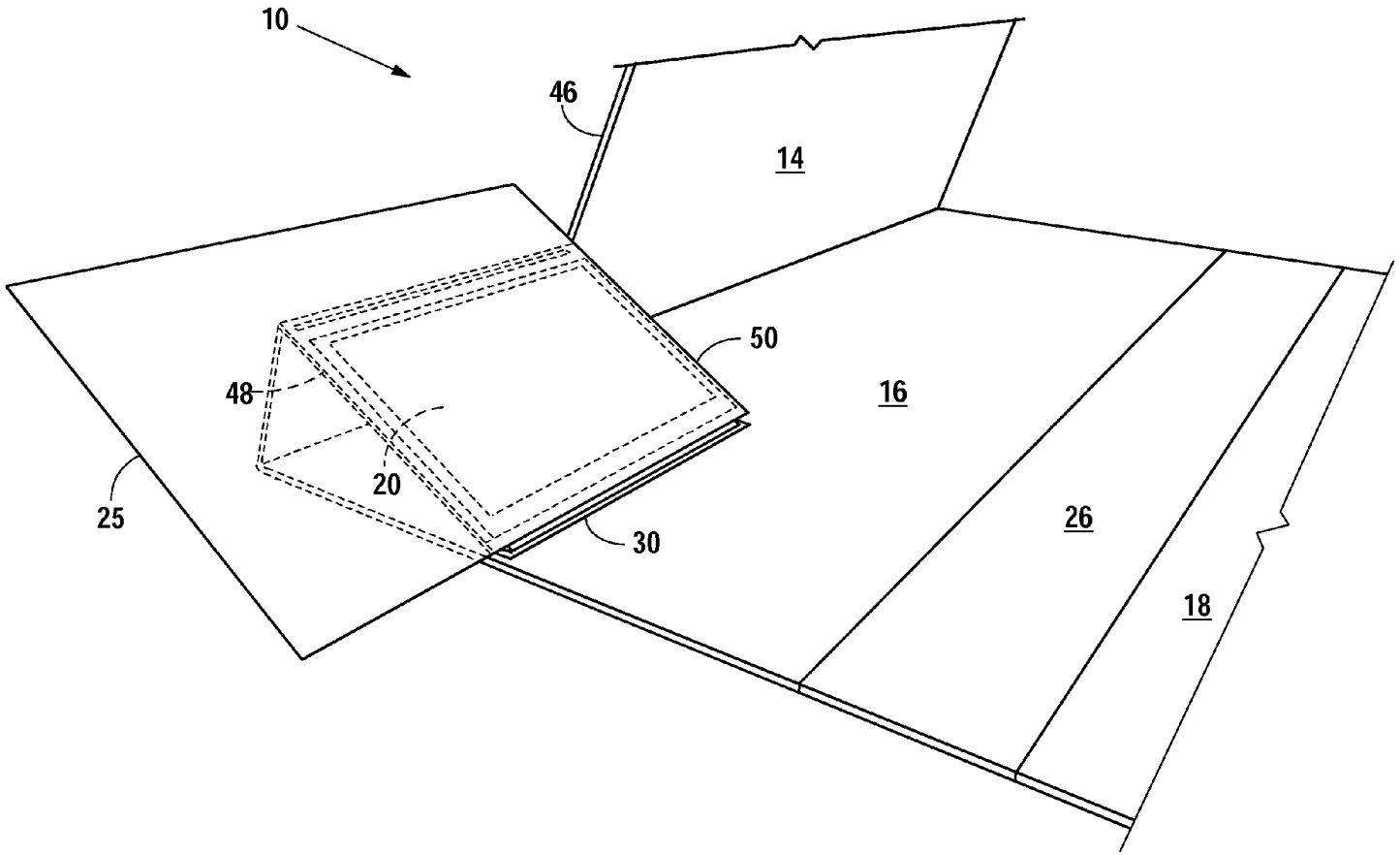
FIG. 8 is an enlarged left perspective view of a portion of the cover and portable electronic device of FIG. 1 similar to FIG. 4 showing a document positioned on the easel.

Referring again to FIGS. 4 and 8, cover 10 may be designed such that in its deployed position easel 20 may receive a business card, check, or other readable object 25 and support the readable object 25 within a field viewable by a camera (not shown) of portable electronic device 15 through the opening 38. Easel 20 may hold the readable object 25 in a suitable stable position with respect to the camera of portable electronic device 15 so that data from the readable object 25 may be accurately and efficiently read into the portable electronic device 15 through the opening 38 in panel 12. The various components of cover 10 may be sized, shaped, and configured so that easel 20 is positioned at a suitable angle and distance with respect to the camera in the deployed position to facilitate such capturing. In some embodiments, easel 20 may include a protrusion at or near closure element 36 that may serve as an abutment for a lower edge of readable object 25 to help align readable object 25 with the camera. Alternatively, stabilizer 30 may serve as such an abutment. Similarly, edge 46 of panel 14 may serve as abutment for a side edge of readable object 25 to help align readable object 25 with the camera. In some embodiments, easel 20 may be configured such that the viewfield of the camera of portable electronic device 15 is sufficient to capture a readable object 25 that is larger than easel 20 and may extend beyond edge 46 of panel 14 and edge 48 of easel 20 as shown in FIG. 8.

Figure 5:
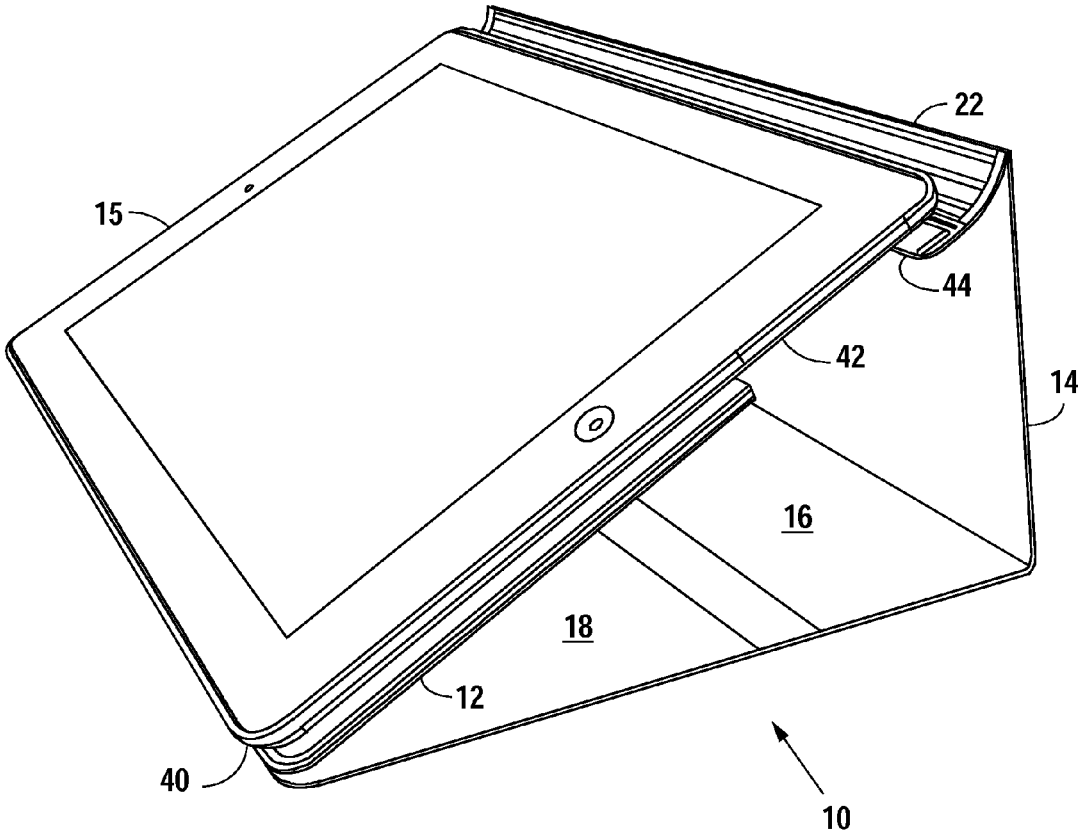
FIG. 5 is a right perspective view of the cover and portable electronic device of FIG. 1 wherein the sound reflector is shown in a retracted position.
Figure 6:
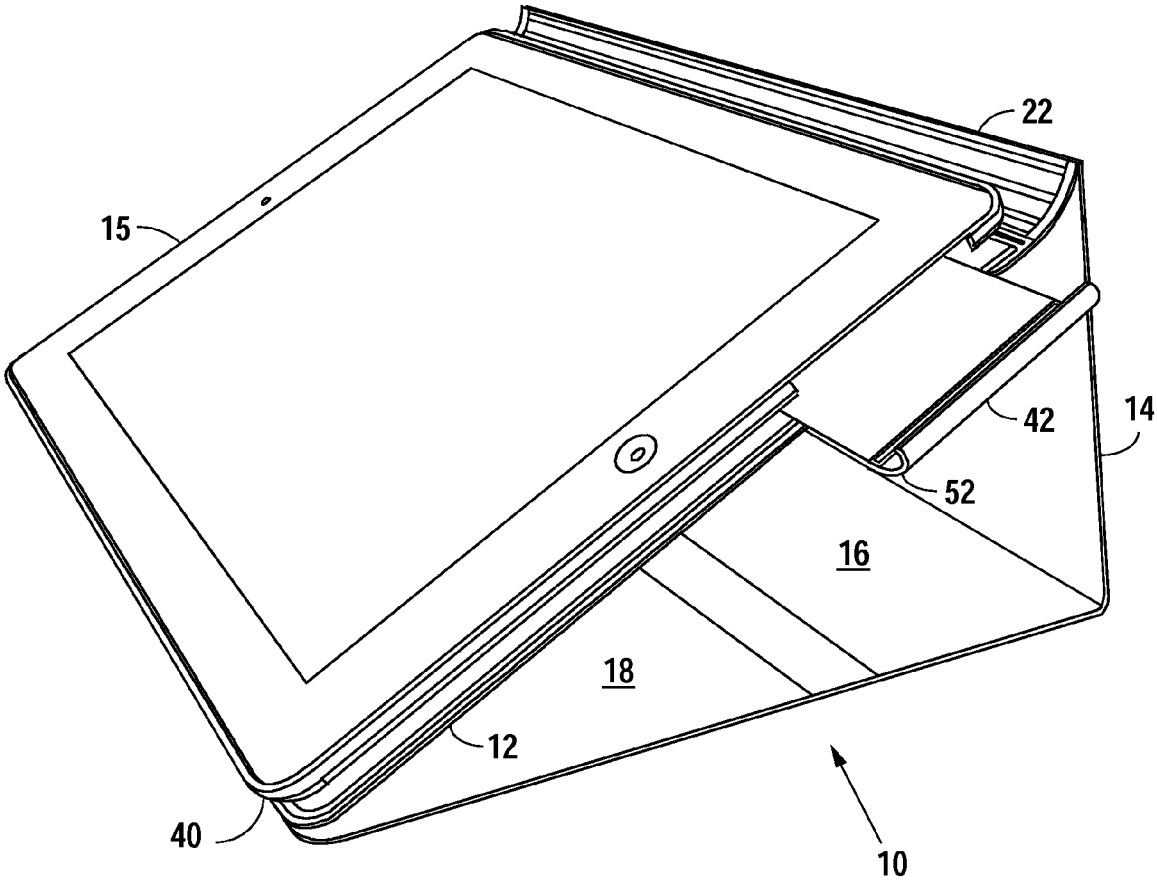
FIG. 6 is a right perspective view of the cover and portable electronic device of FIG. 1 similar to FIG. 5, except the sound reflector is shown in an extended position.

As shown in FIGS. 2, 4, 5, and 6, in some embodiments cover 10 may include an extendable and retractable sound reflector 42 slidably mounted on or in panel 12 that is generally aligned with a speaker (not shown) on a back side of portable electronic device 15 and is configured to cover and uncover the speaker as desired by a user. Panel 12 may have a notch or recess 44 to accommodate sound reflector 42 so that an outer edge portion 52 of sound reflector 42 may be substantially flush with portable electronic device 15 in the retracted position as shown in FIGS. 2 and 5, which protects the speaker against debris and damage. In an extended position as shown in FIGS. 4 and 6, sound reflector 42 may reflect sound from the speaker toward the user and thus enhance the aural user experience of portable electronic device 15 over that which would be experienced if the speaker remained substantially blocked by panel 12. Outer edge portion 52 may be curved so as to better reflect sound in the extended position and fit substantially flush with portable electronic device 15 in the retracted position. Alternatively, instead of being slidably mounted on or in panel 12, sound reflector 42 may be slidably mounted on or in or as part of receptacle 40.

Figure 7:
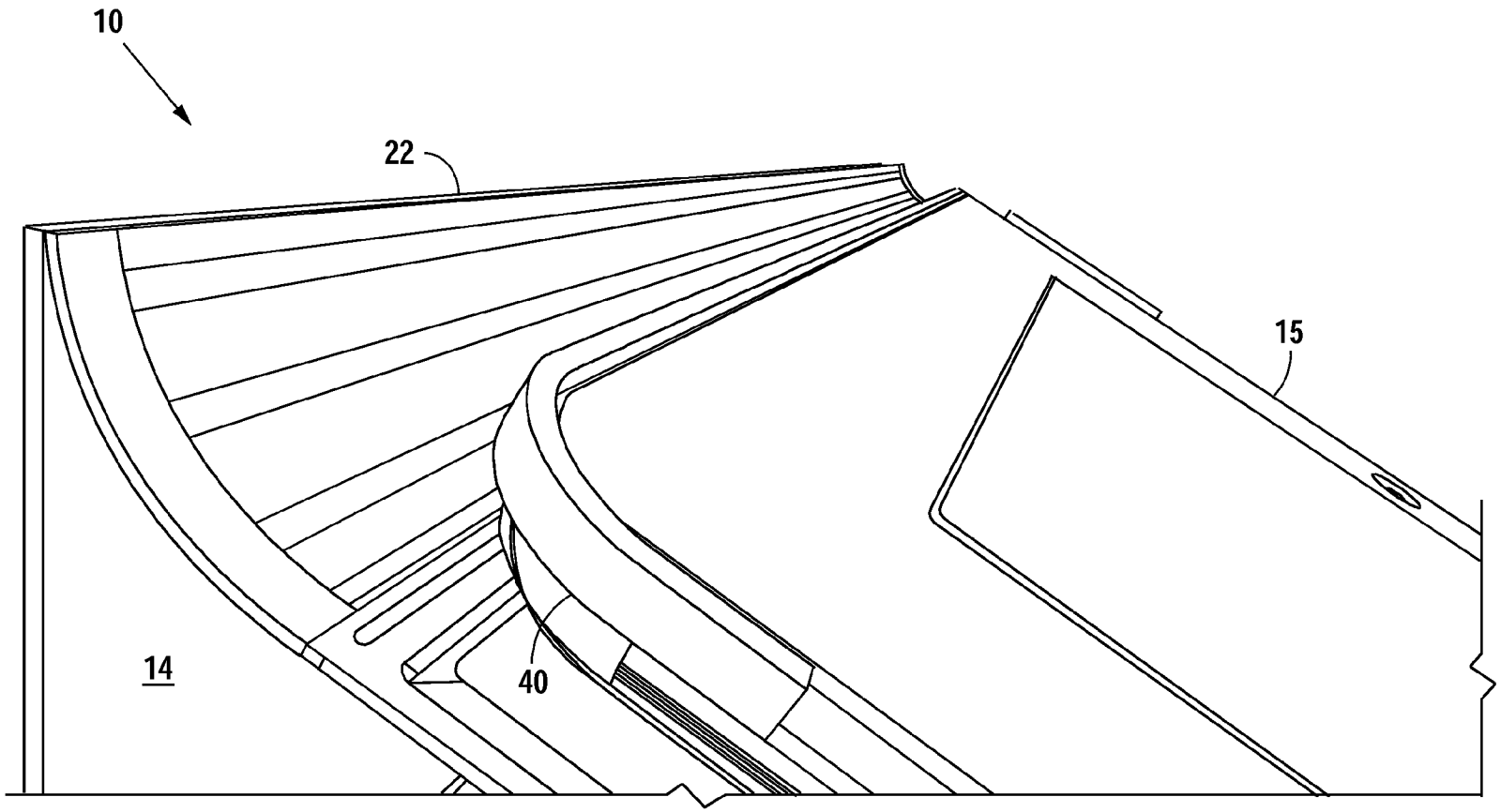
FIG. 7 is an enlarged left perspective view of a portion of the cover and portable electronic device of FIG. 1 similar to FIG. 3 showing a receptacle for retaining the portable electronic device.

As shown in FIG. 7, receptacle 40 may be any desirable type of receptacle for receiving and holding portable electronic device 15 in cover 10. For example, receptacle 40 may have a lip that retains portable electronic device 15 substantially about its entire perimeter, or receptacle 40 may have separate clips, elastic straps, or the like that retain portable electronic device 15 substantially at its corners or other suitable portions thereof. Alternatively, portable electronic device 15 may be fastened to panel 12 by any other suitable means, such as via hook-and-loop fasteners, for example.

Referring again to FIGS. 1 and 2, a closure element 28 may be provided on panel 18 that cooperates with other closure elements (not shown) on panel 12 to hold cover 10 in its closed position as shown in FIG. 2 or in its deployed position as shown in FIGS. 3-6. For example, closure element 28 and its counterparts on panel 12 may include complementary snap components, latch components, hook-and-loop fasteners, a magnet or metal-and-magnet combination, or other suitable means of releasable closure. Such closure elements may be located on a surface of panels 12 and 18, respectively, or partially or fully recessed or embedded therein.

In use, closure element 28 may be released and cover 10 may be unfolded from the closed position shown in FIG. 2 and placed in the deployed position shown in FIG. 3. Closure element 28 may be engaged with a counterpart on panel 12 in order to hold cover 10 in its deployed position. Closure elements 32, 36 may then be released, and easel 20 may be rotated about hinge 34 and thereby moved from its undeployed position shown in FIG. 3 to its deployed position shown in FIG. 4. A readable object 25 may be placed on easel 20 as shown in FIG. 8, and portable electronic device 15 may be operated in order to cause its camera to capture an image of the readable object 25 and thereby read in the relevant data from the readable object 25. For instance, portable electronic device 15 may be programmed to receive captured data from the readable object 25 via the camera, store it in a memory, and display it according to methods known in the art. As persons of ordinary skill in the art will appreciate, a user may use cover 10 and portable electronic device 15 in this manner to easily, quickly, and accurately capture images of various readable objects 25, such as business cards, for example, and automatically read the data from such objects into a memory of portable electronic device 15. Additionally, once cover 10 is placed in the deployed position, sound reflector 42 may be extended as shown in FIGS. 4 and 6 so as to enhance the user's ability to hear sound emanating from the speaker of portable electronic device 15. When portable electronic device 15 is no longer in use, sound reflector 42 may be retracted as shown in FIG. 5, and cover 10 may be folded back up into the closed position as shown in FIG. 2 for compact portability and storage.

Figure 9:
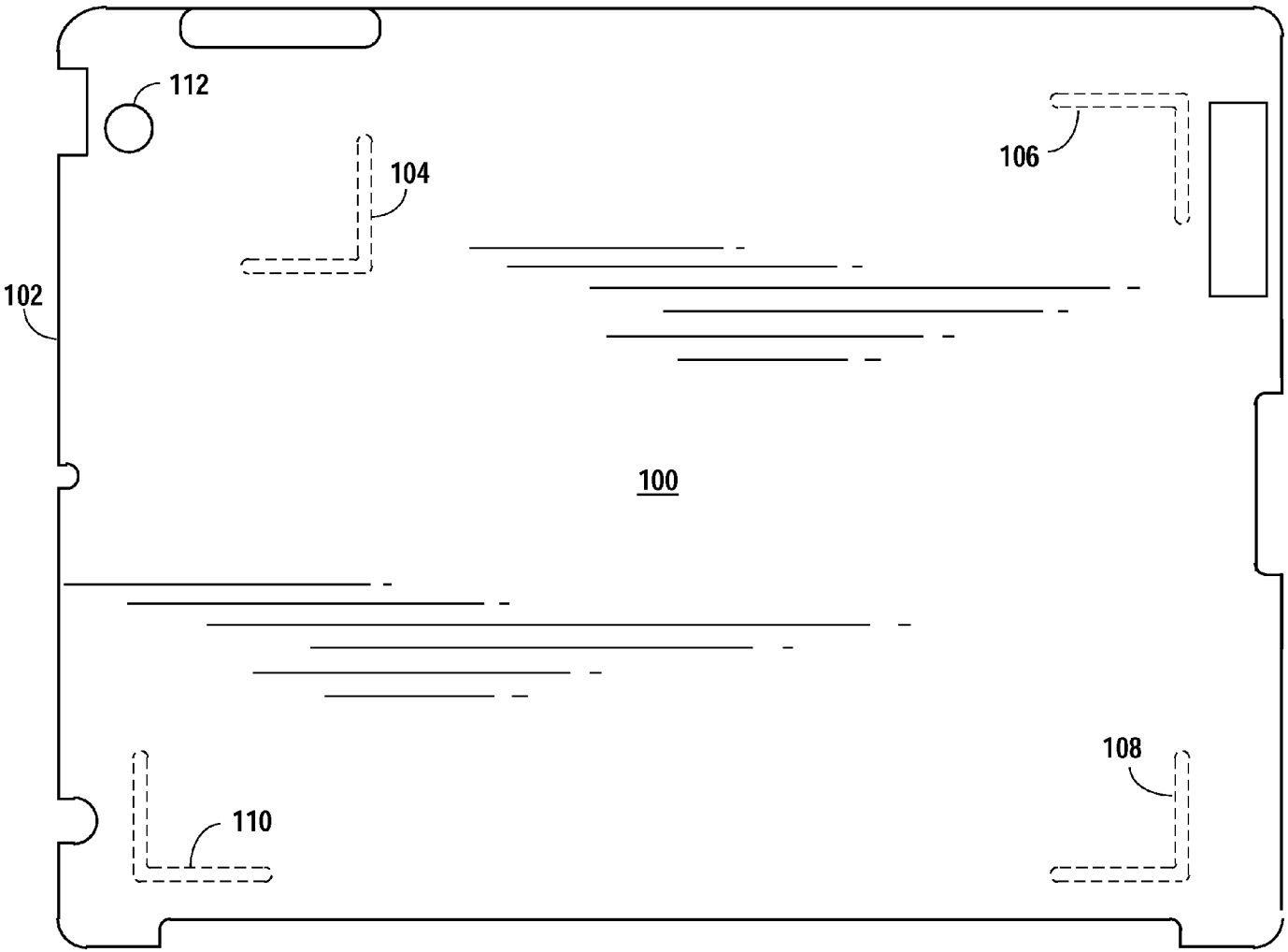
FIG. 9 is a bottom plan view of a stand for a portable electronic device.
Figure 10:
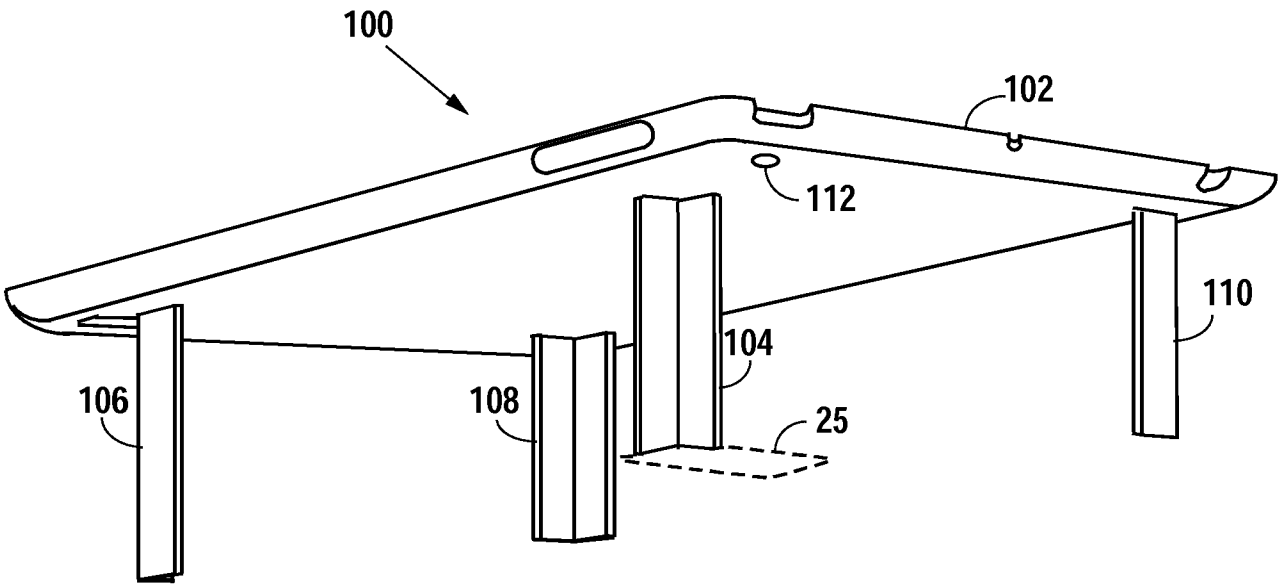
FIG. 10 is a bottom perspective view of the stand of FIG. 9.
Figure 11:
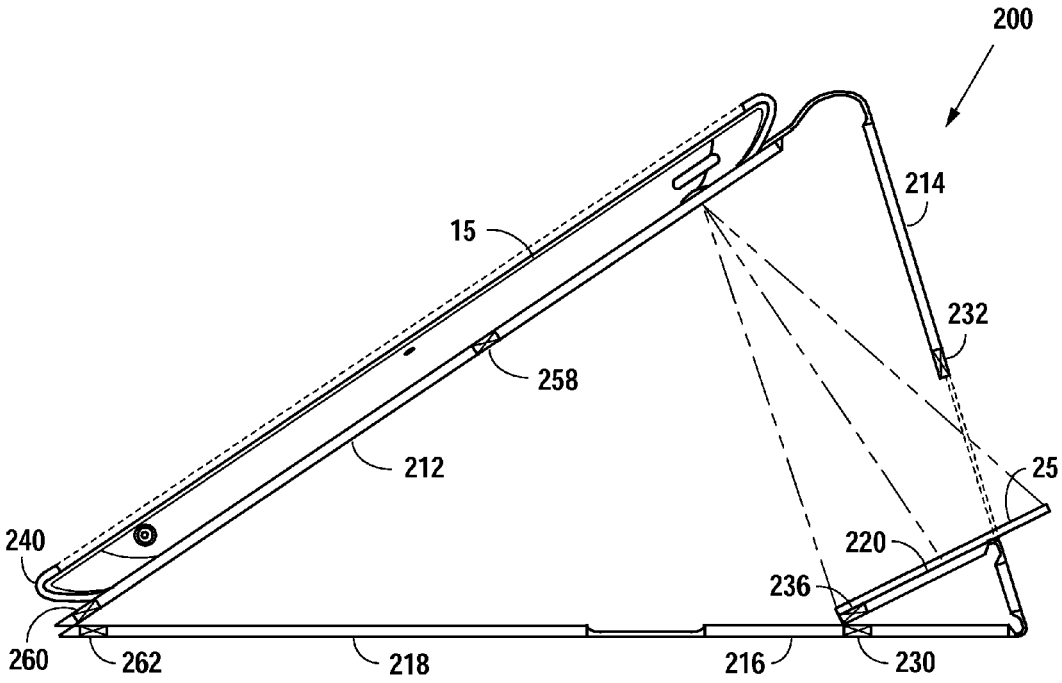
FIG. 11 is a right side elevational view of a cover and a portable electronic device positioned thereon, the cover being in a deployed position, wherein an easel is also shown in a deployed position.
Figure 12:
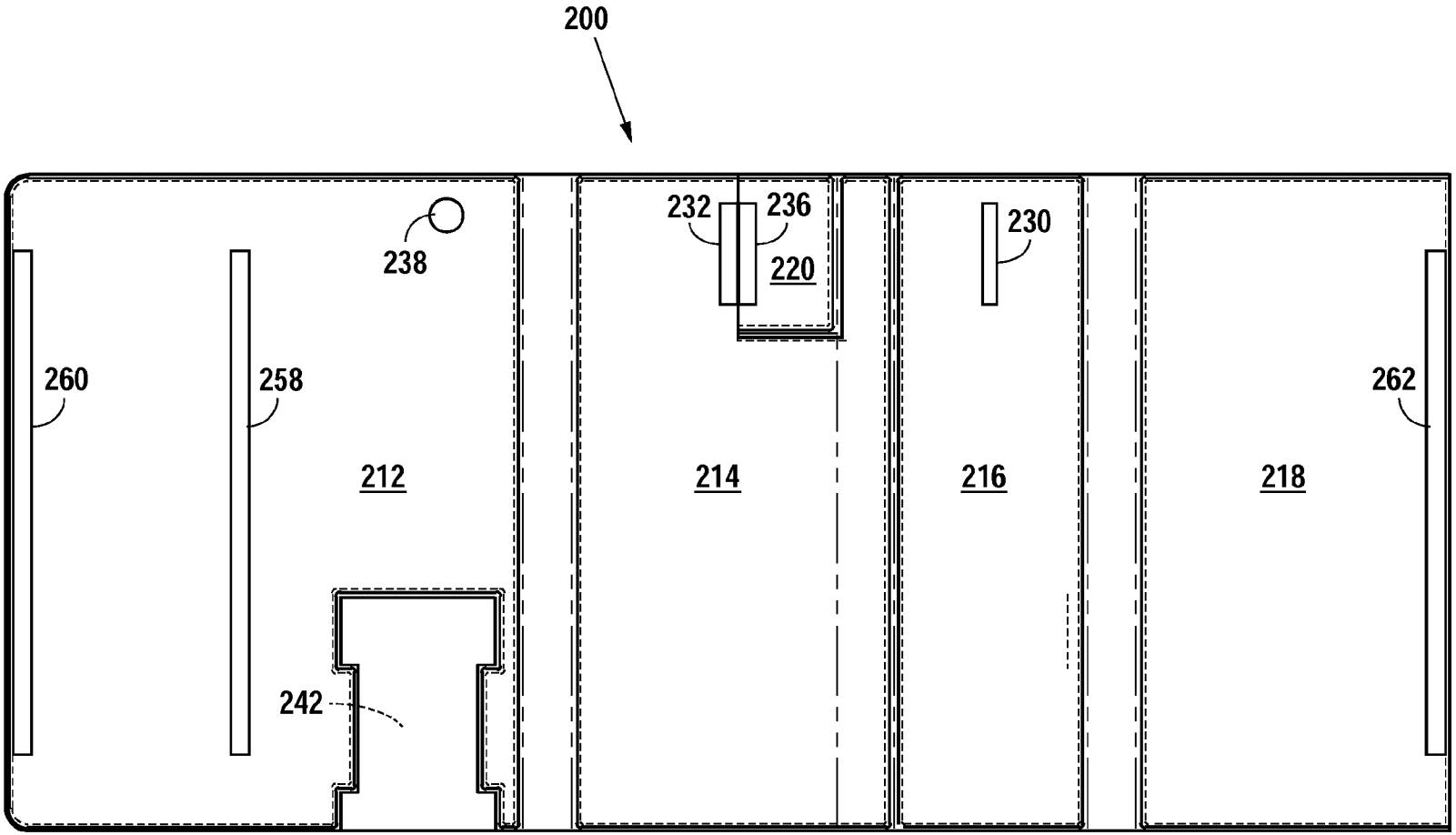
FIG. 12 is a top plan view of the cover of FIG. 11, the cover being in an open position.
Figure 13:
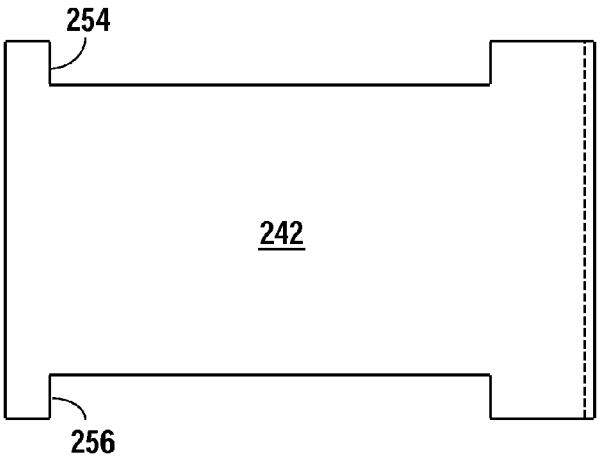
FIG. 13 is a top plan view of a sound reflector.
Figure 14:
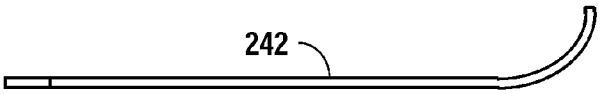
FIG. 14 is a front elevational view of the sound reflector of FIG. 13.
Figure 15:
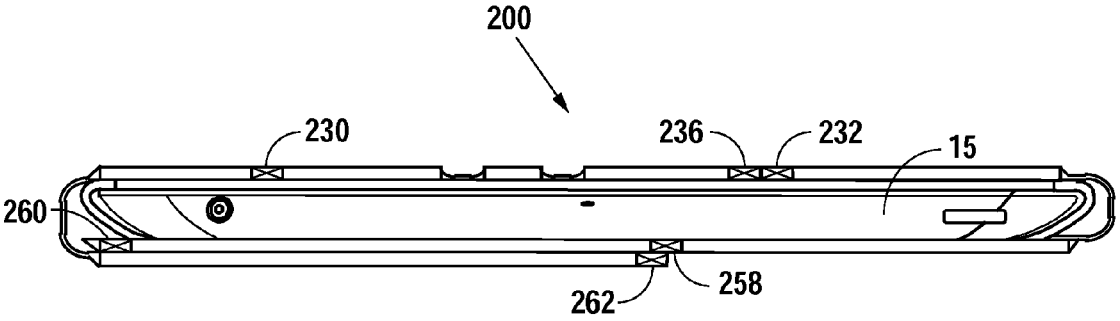
FIG. 15 is a right side elevational view of the cover and portable electronic device of FIG. 11, the cover being in a closed position.

Referring to FIGS. 9 and 10, a stand 100 may have a receptacle 102 configured for receiving a portable electronic device (not shown). Receptacle 102 may have an opening 112 positioned to align with a camera of a portable electronic device. Stand 100 may have one or a plurality of legs 104-110 for holding receptacle 102 a suitable distance above a base surface on which stand 100 may rest. In some embodiments, legs 104-110 may be foldable or retractable so as to be substantially adjacent receptacle 102 in a retracted position. Leg 104 may be configured for positioning a readable object 25 on the base surface in a suitable stable position with respect to the camera of the portable electronic device so that the readable object 25 may be accurately and efficiently captured into the portable electronic device through the opening 112 in receptacle 102 in a manner much like that described above in connection with cover 10. Although legs 104-110 are shown as being four in number and of substantially the same length in FIG. 10, legs 104-110 may be of varying lengths, and more or fewer than four legs may be provided. Of course, still other alternative configurations are possible as well, as will be appreciated by persons of ordinary skill in the art. For example, in some embodiments, legs 108 and 110 may be shortened or eliminated such that receptacle 102 may assume an angled position much like that of panel 12 and receptacle 40 as shown in FIG. 3.

Referring to FIGS. 11-15, another embodiment of a cover 200 is shown which is similar to cover 10 described above, except that its sound reflector 242 may have retention tabs 254, 256 that may engage with internal stops in panel 212 (such as a sewn or fused seam, for example) in order to limit the sliding movement of sound reflector 242 such that it may not be completely removed from cover 200. Additionally, in this embodiment, magnets 230, 232, and 236 may be embedded in or otherwise attached to panels 216, 214, and easel 220, respectively, in order to hold easel 220 in deployed (FIG. 11) and undeployed (FIG. 12) positions. Similarly, magnets 258 and 260 may be embedded in or otherwise attached to panel 212, and magnet 262 may be embedded in or otherwise attached to panel 218 in order to hold cover 200 in deployed (FIG. 11) and closed (FIG. 15) positions. Similar to cover 10 described above, cover 200 may have a receptacle 240 on panel 212 configured to receive a portable electronic device 15 and may be designed such that in its deployed position easel 220 may receive a business card, check, or other readable object 25 and support the readable object 25 within a field viewable by a camera (not shown) of portable electronic device 15 through an opening 238. Easel 220 may hold the readable object 25 in a suitable stable position with respect to the camera of portable electronic device 15 so that data from the readable object 25 may be accurately and efficiently read into the portable electronic device 15 through opening 238 in panel 212. The various components of cover 200 may be sized, shaped, and configured so that easel 220 is positioned at a suitable angle and distance with respect to the camera in the deployed position to facilitate such capturing.

The embodiments described above are some examples of the current invention. Various modifications and changes of the current invention will be apparent to persons of ordinary skill in the art. Among other things, any feature described for one embodiment may be used in any other embodiment. The scope of the invention is defined by the appended claims and other claims that may be drawn to this disclosure, considering the doctrine of equivalents, and is not limited to the specific examples described herein.

What is claimed is:

1. A cover for a portable electronic device, comprising:

a plurality of foldable panels;

a receptacle connected to at least one of said plurality of panels and configured to receive a portable electronic device having a camera, at least one of said plurality of panels comprising an opening configured to align with the camera when the portable electronic device is received in said receptacle; and an easel hingedly connected to at least one of said plurality of panels;

wherein said easel is positionable in a deployed position in which said easel is configured to support a readable object within a field viewable through said opening by the opening-aligned camera.

2. The cover of claim 1 further comprising an extendable and retractable sound reflector slidably mounted on or in said receptacle or one of said plurality of panels.

3. The cover of claim 2 further comprising a stop configured for engagement with a tab of said sound reflector to limit extendable movement of said sound reflector such that said sound reflector is not completely removable from said cover.

4. The cover of claim 2 wherein a portion of said sound reflector is configured to be substantially flush with a portion of the portable electronic device in a retracted position.

5. The cover of claim 1 wherein said easel comprises a first closure element and said at least one of said plurality of panels comprises a second closure element, wherein said first and second closure elements are configured to releasably hold said easel in an undeployed position.

6. The cover of claim 5 wherein said first and second closure elements are selected from complementary snap components, latch components, hook-and-loop fasteners, magnets, a metal-and-magnet combination, and combinations thereof.

7. The cover of claim 5 wherein a free edge of said easel is substantially flush with an edge of said at least one of said plurality of panels in said undeployed position.

8. The cover of claim 5 wherein one of said plurality of panels comprises a stabilizer configured to engage with said first closure element of said easel to releasably hold said easel in said deployed position.

9. The cover of claim 8 wherein said stabilizer comprises a third closure element selected from a snap component, latch component, hook-and-loop fastener component, magnet component, metal component, and combinations thereof that is complementary to said first closure element of said easel.

10. The cover of claim 9 wherein said second and third closure elements are of the same type.

11. The cover of claim 10 wherein one of said plurality of panels comprises a fourth closure element and another of said plurality of panels comprises a fifth closure element, wherein said fourth and fifth closure elements are configured to releasably hold said cover in a closed position.

12. The cover of claim 11 wherein one of said plurality of panels comprises a sixth closure element, and wherein said sixth closure element is configured to cooperate with said fourth or fifth closure element to releasably hold said cover in a deployed position.

13. The cover of claim 11 wherein at least two of said plurality of panels are configured to at least partially overlap each other in said closed position.

14. The cover of claim 1 wherein said easel is located at an outer edge of one of said plurality of panels.

15. The cover of claim 1 wherein said easel is located at an inner portion of one of said plurality of panels.

16. The cover of claim 1 wherein said plurality of panels and said easel comprise hinges configured to permit a predetermined degree of rotation such that said plurality of panels and said easel releasably lock into desired positions with respect to the camera when said easel is in said deployed position.

17. A cover for a portable electronic device, comprising:

a plurality of foldable panels comprising a main panel, a support panel hingedly connected to said main panel, a base panel hingedly connected to said support panel, and a closure panel hingedly connected to said base panel;

a receptacle connected to said main panel and configured to receive a portable electronic device having a camera, said main panel comprising an opening configured to align with the camera;

an extendable and retractable sound reflector slidably attached to said main panel, said main panel comprising a stop configured for engagement with a tab of said sound reflector to limit extendable movement of said sound reflector such that said sound reflector is not completely removable from said cover, wherein a portion of said sound reflector is configured to be substantially flush with a portion of the portable electronic device in a retracted position;

an easel hingedly connected to said support panel and comprising a first closure element;

said support panel comprising a second closure element, wherein said first and second closure elements are configured to releasably hold said easel in an undeployed easel position in which said easel is substantially flush with said support panel;

said base panel comprising a stabilizer comprising a third closure element, wherein said first and third closure elements are configured to releasably hold said easel in a deployed easel position in which said easel is configured to support a readable object within a field viewable through said opening;

said plurality of panels being foldable into a substantially flat closed cover position in which said closure panel partially overlaps said main panel and a substantially triangular deployed cover position in which said main panel is disposed at an acute angle with respect to said closure panel;

said main panel comprising a fourth closure element and a fifth closure element;

said closure panel comprising a sixth closure element;

said fourth and sixth closure elements being configured to releasably hold said cover in said closed cover position; and said fifth and sixth closure elements being configured to releasably hold said cover in said deployed cover position.

18. The cover of claim 17 wherein each of said closure elements comprises an embedded magnet.

* * * * *